US006044824A

United States Patent [19]

Mamiya et al.

[11] Patent Number: 6,044,824

[45] Date of Patent: Apr. 4, 2000

[54] FUEL CONTROL UNIT AND FUEL INJECTION CONTROL METHOD FOR MULTI-CYLINDER ENGINE

[75] Inventors: Kiyotaka Mamiya, Higashihiroshima; Michihiro Imada; Masayuki Tetsuno, both of Hiroshima; Yasuyoshi Hori, Himeji; Kouhei Iwai, Hiroshima; Hideshi Terao, Higashihiroshima, all of Japan

[73] Assignee: Mazda Motor Corporation, Hiroshima-ken, Japan

[21] Appl. No.: 09/237,855

[22] Filed: Jan. 27, 1999

[30] Foreign Application Priority Data

Jan. 29, 1998 [JP] Japan ..... 10-017465

[51] Int. Cl.[7] ..... F02M 51/00

[52] U.S. Cl. ..... 123/492; 123/491

[58] Field of Search ..... 123/492, 491

[56] References Cited

U.S. PATENT DOCUMENTS

| | | | |
|---|---|---|---|
| 5,146,882 | 9/1992 | Brinkman et al. | 123/491 |
| 5,526,794 | 6/1996 | Messih et al. | 123/492 |
| 5,595,161 | 1/1997 | Ott et al. | 123/491 |
| 5,765,533 | 6/1998 | Nakajima | 123/492 |
| 5,931,136 | 8/1999 | Isobe et al. | 123/492 |
| 5,934,259 | 8/1999 | Onishi | 123/491 |
| 5,947,088 | 9/1999 | DeGroot et al. | 123/492 |
| 5,970,947 | 10/1999 | Lida et al. | 123/492 |

FOREIGN PATENT DOCUMENTS

| | | |
|---|---|---|
| 1-3245 | 1/1989 | Japan . |
| 1-32037 | 2/1989 | Japan . |

*Primary Examiner*—John Kwon

*Attorney, Agent, or Firm*—Nixon Peabody LLP; Donald R. Studebaker

[57] ABSTRACT

A fuel control unit and a fuel injection control method for a multi-cylinder engine adjust the pulse width of asynchronous injection so as to set the air-fuel ratio of a fuel-air mixture in a first cylinder to 17 or more but under 21 if it is determined according to an engine speed (Ne) that an engine is in an idling mode and if it is determined according to the opening of a throttle valve that a condition for starting the acceleration of the engine has been satisfied. The foregoing first cylinder is the cylinder in which compression pressure increases first following the determination described above.

23 Claims, 8 Drawing Sheets

FUEL CONTROL UNIT AND FUEL INJECTION CONTROL METHOD FOR MULTI-CYLINDER ENGINE

BACKGROUND OF THE INVENTION

1. Field of the Invention

The present invention relates to a fuel control unit and a fuel injection control method for controlling the supply of fuel to the respective cylinders of a multi-cylinder engine and, more particularly, to a fuel injection control art for suppressing the occurrence of abnormal combustion when the operation of an engine shifts from an idling mode to an acceleration mode.

2. Description of the Related Art

Japanese Patent Publication No. 1-3245, for example, discloses an art in which fuel is injected at a different timing from synchronous timing to increase the fuel (hereinafter referred to as "asynchronous injection") in addition to the fuel injection for each cycle to each cylinder (hereinafter referred to as "synchronous injection") when an engine shifts to the acceleration mode. According to the art, as soon as the opening of a throttle valve is detected when the engine shifts from a steady operation mode to the acceleration mode, the amount of the fuel supplied to the engine is increased by the asynchronous injection at a preset pulse width so as to prevent a fuel-air mixture from becoming overlean due to delayed fuel transport in each cylinder of the engine, thereby maintaining good acceleration performance of a vehicle.

In the foregoing conventional art, for each cylinder shifting to an intake stroke after the asynchronous injection is carried out, the injection pulse width for the asynchronous injection is adjusted to be smaller as the time required for the respective cylinders to shift to the intake stroke is prolonged so as to improve the variations in the fuel-air mixture attributable to the difference in the carbureting and atomizing time required for the fuel-air mixture to be taken into each cylinder through an intake port.

As in the case of recent automobiles, however, designing an engine to have a higher compression ratio or setting the idling rpm at a lower value to enhance the vehicular fuel economy is likely to lead to more chances of abnormal combustion or preignition accompanied by a sudden increase in pressure at the time of a shift from idling to acceleration. The abnormal combustion causes the engine to produce a considerably loud abnormal noise, making a driver extremely uncomfortable.

The abnormal combustion inevitably takes place if an intake air temperature is high to a certain degree and an engine having a high compression ratio is running at a low rpm. At this time, it is considered that the fuel-air mixture in a cylinder burns at once, resulting in a considerably greater increase in pressure than that in the combustion based on normal flame propagation.

More specifically, as shown in FIG. 9, the fuel-air mixture in a cylinder is activated to begin chemical reaction at point "a" in the figure as the pressure increases; then, it suddenly reaches a combustion mode at point "b" after the elapse of an ignition delay time. When attention is paid to the ignition delay time from point "a" to point "b" mentioned above, it is found that the ignition delay time becomes shorter as the engine speed decreases. Further, if the air-fuel ratio of the fuel-air mixture is leaner than a stoichiometric ratio, then the ignition delay time tends to be shorter as the air-fuel ratio is richer. Accordingly, in FIG. 9, as the engine speed decreases or as the air-fuel ratio of the fuel-air mixture is richer, point "b" moves closer to an upper compression dead point and the rise in pressure caused by abnormal combustion increases.

Regarding the abnormal combustion and the resulting noise described above, the foregoing conventional art has been presenting a problem in that the asynchronous injection performed at the time of the shift from idling to acceleration causes the air-fuel ratio of a fuel-air mixture to become excessively rich.

More specifically, although the variations in the air-fuel ratio for a cylinder that is not in the intake stroke at the time of asynchronous injection are improved, no considerations have been given to a cylinder that is in the middle of the intake stroke. In the cylinder that is in the middle of the intake stroke when a throttle valve is opened, a fixed amount of fuel is supplied by the asynchronous injection whereas the actual amount of intake air into the cylinder decreases as the opening timing of the throttle valve is delayed. Therefore, as illustrated in FIG. 10, the air-fuel ratio becomes richer as the opening timing of the throttle valve or the acceleration start timing is delayed, and it becomes excessively rich, exceeding a preignition limit at which preignition occurs.

Therefore, a significantly loud noise is produced in such a case where a vehicle starts acceleration after escaping from a traffic jam, and the air that has been warmed in a surge tank is supplied to the engine in a nearly idling mode as the throttle valve is opened and the asynchronous injection is performed at the same time. This is because, in a cylinder that is in the middle of the intake stroke when the throttle valve is opened, the air-fuel ratio of the fuel-air mixture becomes unduly rich, and this is coupled with a high intake air temperature, a high compression ratio, and a low rpm, leading to preignition with a consequent loud noise.

As a solution to the problem set forth above, the amount of the asynchronous injection could be set to a smaller value in order to prevent the air-fuel ratio from becoming too rich; however, doing so would make it impossible to successfully accomplish the original purpose of preventing the deterioration in acceleration performance by increasing the amount of fuel at the beginning of the acceleration of the engine.

Japanese Patent Publication No. 1-32037 discloses the following art. Injection is performed simultaneously according to an injection time, which has been set in the fuel injection valve of each cylinder, when it is determined from a change in the opening of a throttle valve that acceleration has been engaged. For this purpose, the injection time is set so as to provide a lean air-fuel ratio close to but not in a misfire zone for a cylinder in a period between the end of synchronous injection and the end of an intake stroke, and to provide a rich air-fuel ratio close to but not in the misfire zone for the rest of the cylinders. Thus, the air-fuel ratio of each cylinder is controlled to be shifted toward the rich or lean side away from the stoichiometric ratio in accordance with the air-fuel ratio of each cylinder at the time of an acceleration start thereby to prevent knocking.

However, the art disclosed in Japanese Patent Publication No. 1-32037 is not designed to detect the idling rpm of an engine and it is not adapted to determine acceleration after detecting the idling mode of the engine in order to adjust the air-fuel ratio of a first cylinder, in which the filling amount is increased by the release of the throttle valve and the compression pressure substantially increases, to a predetermined air-fuel ratio range. Hence, at the shift from idling to acceleration for a start, too much fuel is supplied for the absolute filling amount of the cylinder which is in the intake stroke and in which the filling amount is increased first, thus leading to a danger of a preignition or abnormal noise as the time of the expansion stroke of the cylinder is prolonged.

SUMMARY OF THE INVENTION

Accordingly, the present invention has been made with a view toward solving the problem described above, and it is an object thereof to provide a fuel control unit and a fuel injection control method for a multi-cylinder engine that enable the prevention of the occurrence of preignition and an abnormal noise accompanying the preignition without sacrificing vehicular accelerating performance, by employing a devised fuel control procedure for shifting from the idling mode to the acceleration mode as set forth below.

To this end, according to the present invention, the degree of an increase of fuel is adjusted in relation to an acceleration start timing and the fluctuation width of an air-fuel ratio when an engine shifts from the idling mode to the acceleration mode.

More specifically, according to one aspect of the present invention, there is provided a fuel control unit for a multi-cylinder engine equipped with: an acceleration start determiner for determining that a condition for starting the acceleration of the multicylinder engine has been satisfied; fuel supplying device for supplying fuel independently to respective cylinders of the engine; and a fuel increaser for causing the fuel supplying device to supply fuel to increase the amount of fuel at the time of acceleration when the acceleration start determiner determines that the condition for starting the acceleration has been satisfied.

In a first preferred form of the invention, when the idling of the engine has been determined as a result of the determination of the idling of the engine and the acceleration start determiner has determined that the condition for starting the acceleration of the engine has been satisfied, the degree of an increase of fuel effected by the fuel increaser is adjusted to be smaller so that the air-fuel ratio of a fuel-air mixture in a first cylinder, in which compression pressure is substantially increased first by an increase in the intake air filling amount caused by the opening of a throttle valve after the determination, lies in a predetermined range.

The foregoing cylinder in which the compression pressure substantially increases refers to a cylinder in which the intake air filling amount increases as the throttle valve is opened and the pressure or the compression pressure at a compression upper dead point is high enough for the fuel-air mixture to be self-ignited. When the compression pressure is sufficiently high, preignition will automatically take place if a condition involving such factors as an air-fuel ratio and engine speed is satisfied. Although it depends on the specifications or the like of an engine, a cylinder in the period between the end of an exhaust stroke and the middle of an intake stroke when the throttle valve is opened is usually the first cylinder.

With this arrangement, when the idling of the engine has been determined and the acceleration start determiner has determined that the condition for starting the acceleration of the engine has been satisfied, the degree of an increase of the fuel effected by the fuel increaser is adjusted to be smaller so that the air-fuel ratio of the fuel-air mixture lies in the predetermined range in the first cylinder in which the preignition is expected to take place first after the determination of the acceleration start. This makes it possible to prevent the air-fuel ratio of the fuel-air mixture in the first cylinder from becoming excessively rich thereby to prevent the occurrence of preignition and the consequent abnormal noise.

If the engine speed is increased by the combustion of the first cylinder, the occurrence of the preignition is suppressed in a cylinder to be ignited next even if there are variations in the fuel-air mixture.

In a second preferred form of the invention, the adjustment made in the first preferred form is carried out to decrease the degree of the increase of fuel effected by the fuel increaser so that the air-fuel ratio in a second cylinder, in which the compression pressure is substantially increased following the first cylinder, is also within a predetermined range. Thus, the air-fuel ratio of the fuel-air mixture in the second cylinder is set to a value within the predetermined range; therefore, for example, even if the engine speed fails to be increased due to a misfire or the like in the first cylinder, preignition can be prevented from taking place in the second cylinder.

In a third preferred form of the invention, the adjustment made in the first or second preferred form is carried out to suspend the adjustment of the degree of the increase in fuel if an engine is not yet warmed up. In general, when an engine has not been warmed up yet, the carbureting and atomizing of fuel is not performed smoothly and therefore less fuel is taken into a cylinder through an intake port. For this reason, hesitation or other drivability problems can be prevented by making no adjustment in the degree of the increase in fuel amount so as to sufficiently increase the amount of fuel at the beginning of acceleration. Usually, preignition does not occur while an engine is still unwarmed.

In a fourth preferred form of the invention, the adjustment made in any of the first to third preferred forms is carried out to increase the amount of fuel only if the intake air temperature is 80 degrees Celsius or higher. Thus, since preignition seldom takes place when the intake air temperature is lower than 80 degrees Celsius, accelerating performance can be improved by making no adjustment for decreasing the degree of the increase of fuel so as to ensure sufficient increase in the amount of fuel at the start of acceleration.

In a fifth preferred form of the invention, the air-fuel ratio in the predetermined range in any one of the first to fourth preferred forms is defined as A/F>14.7, the difference between maximum and minimum values being 5 or less in terms of A/F. Hence, preignition and the consequent abnormal noise and deterioration in the accelerating performance can be reliably prevented by controlling the variations in the air-fuel ratio of a fuel-air mixture to the predetermined range.

In a sixth preferred form of the invention, the adjustment in any one of the first to fifth preferred forms is performed to reduce the degree of the increase of fuel effected by the fuel increaser as the timing for determining the acceleration start is delayed if the first cylinder is in the period between the end of an exhaust stroke and an intake stroke when the acceleration start determiner determines the acceleration start of an engine. Thus, if the first cylinder is in the period between the end of an exhaust stroke and an intake stroke when the acceleration start determiner determines the acceleration start of an engine, i.e. when a throttle valve is opened, then the amount of intake air drawn into the first cylinder is reduced as the timing at which the throttle valve is opened is delayed; therefore, by making adjustment to accordingly reduce the degree of the increase of fuel by the fuel increaser, the air-fuel ratio of the fuel-air mixture in the first cylinder can be adjusted to a value within the predetermined range.

In a seventh preferred form of the invention, the fuel increaser in the sixth preferred form causes the fuel supplying device to supply fuel as soon as the acceleration start determiner determines that the condition for starting the acceleration of an engine has been satisfied. Thus, since fuel is supplied to increase the amount of fuel immediately when it is determined that the condition for starting the acceleration of an engine has been satisfied, the time for atomization and carburetion of fuel is prolonged as much as possible to secure an adequate amount of fuel supplied to a cylinder.

In an eighth preferred form of the invention, the fuel increaser in the sixth preferred form causes the fuel supplying device to supply fuel at a predetermined supply timing in an intake stroke when the acceleration start determiner determines that the condition for starting the acceleration of an engine has been satisfied. Thus, fuel can be efficiently supplied to a cylinder by supplying fuel to increase the amount of fuel at the predetermined intake point during an intake stroke so as to permit the cylinder to be filled with sufficient fuel. Further, supplying fuel for adding to the amount of fuel mentioned above at a different timing from the timing for basic fuel supply makes it possible to obviate adverse influences caused by the mutual interference of the foregoing two types of fuel supply.

In a ninth preferred form of the invention, the fuel increaser in the eighth preferred form makes adjustment so as to advance the predetermined supply timing as the engine rpm increases. Thus, even when the engine rpm increases to cause the open duration of an intake valve to be relatively shorter, the fuel supply timing at which the fuel increaser supplies fuel is advanced to make up for it accordingly. This allows sufficient time for atomization and carburetion of fuel, enabling sufficient fuel to be supplied to a cylinder.

In a tenth preferred form of the invention, the engine in any one of the first to ninth preferred forms is assumed to be set to have a compression ratio of 9 or more and an idling rpm of 600 or less. In general, an engine which has been set to have a high compression ratio of 9 or more and a low idling rpm of 600 or less is apt to incur preignition. Therefore, the advantages of the invention can be applied especially effectively to such an engine.

In an eleventh preferred form of the invention, the engine in any one of the first to tenth preferred forms is mounted on a vehicle equipped with an automatic transmission. In most vehicles provided with automatic transmissions, when the drivers of the vehicles depress accelerator pedals to start the vehicles, the engines are immediately shifted to acceleration mode from idling mode, frequently causing preignition. Hence, the advantages of the invention can be applied especially effectively to the engines of such vehicles.

According to another aspect of the invention, there is provided a fuel control unit for a multi-cylinder engine having an injector which supplies fuel independently to each cylinder of the multi-cylinder engine, and a control processing unit which determines that a condition for starting the acceleration of the engine has been satisfied, and which causes the injector to supply fuel to increase the amount of fuel for the acceleration when it determines that a condition for starting the acceleration of the engine has been satisfied, the fuel control unit further including: an idling determination processor which determines an idling mode of the engine; and an adjustment processor which makes an adjustment to reduce the degree of an increase of fuel effected by the injector so as to control the air-fuel ratio of a fuel-air mixture in a cylinder, in which compression pressure increases first due to an increase in the amount of intake air charged when a throttle valve is opened after the control processing unit determines that the condition for starting the acceleration of the engine has been satisfied, with the idling mode of the engine having been determined by the idling determination processor, to a value within a predetermined range; wherein the adjustment processor makes an adjustment so as to reduce the degree of the increase of fuel effected by the injector as the timing at which the acceleration start is determined is delayed if a first cylinder is in a period between the end of an exhaust stroke and an intake stroke when the control processing unit determines the acceleration start of the engine thereby to provide the same advantage as that obtained in the first preferred form of the invention.

Other objects and advantages besides those discussed above shall be apparent to those skilled in the art from the description of preferred embodiments of the invention which follow. In the description, reference is made to accompanying drawings, which form a part thereof, and which illustrate examples of the invention. Such examples, however, are not exhaustive of various embodiments of the invention, and therefore reference is made to the claims which follow the description for determining the scope of the invention.

DETAILED DESCRIPTION OF PREFERRED EMBODIMENTS

The embodiments of the invention will now be described in detail with reference to the accompanying drawings.

First Embodiment

Figure 1:
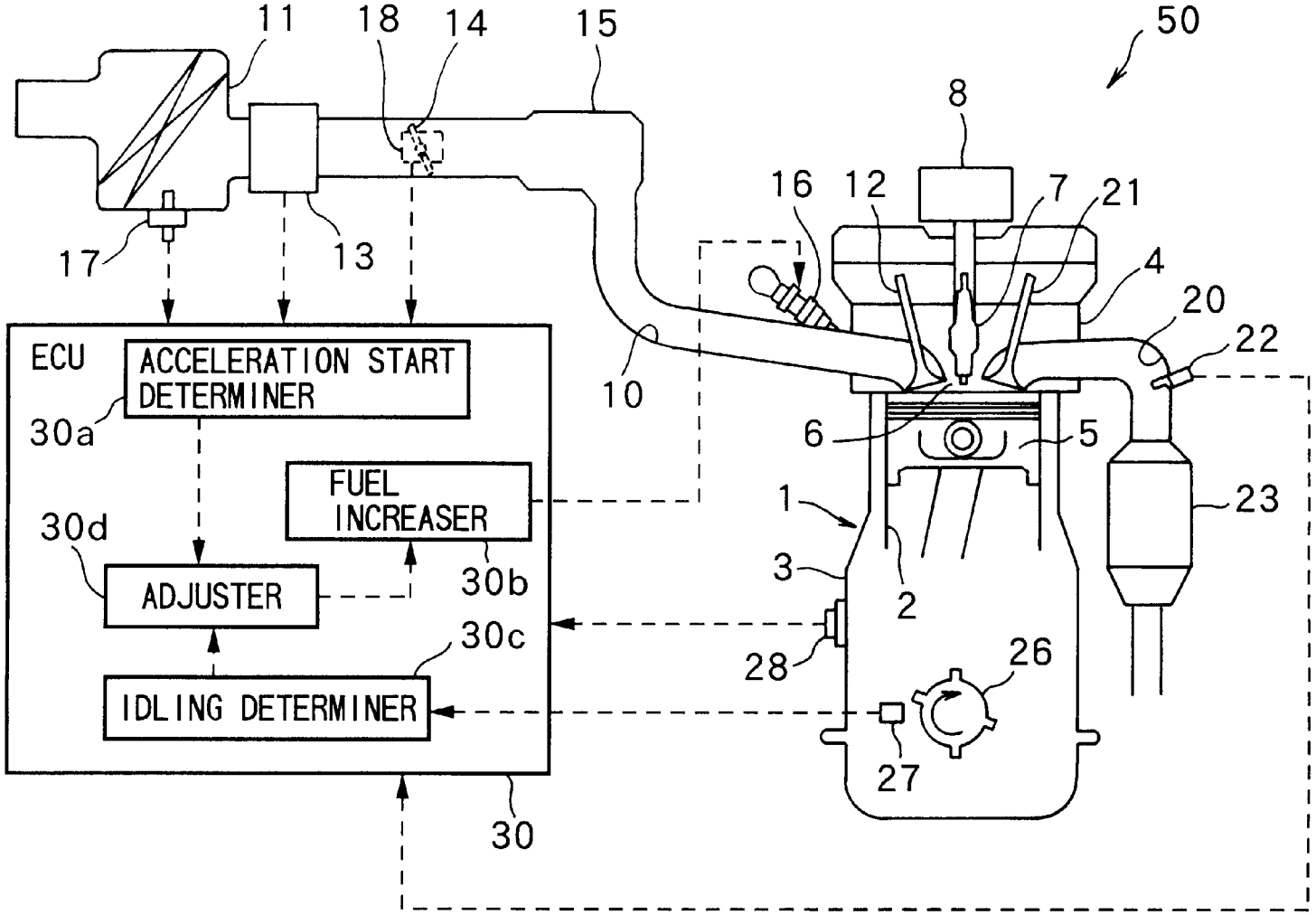
FIG. 1 is a general block diagram showing an embodiment of the invention.

FIG. 1 shows a fuel injecting unit 50 according to a first embodiment in which the invention has been applied to a straight four, 4-stroke gasoline engine 1.

As shown in FIG. 1, in order to reduce fuel cost, the engine 1 has been designed to have a high compression ratio of 9.5 and an idling speed of 600 rpm or less. The engine is mounted on a vehicle equipped with an automatic transmission.

The engine 1 is provided with a cylinder block 3 having four cylinders 2, a cylinder head 4 mounted on the top surface of the cylinder block 3, and a piston 5 fitted in each cylinder 2 in such a manner that it is able to reciprocate. A combustion chamber 6 surrounded by the piston 5 and the cylinder head 3 is formed in each cylinder 2. A spark plug 7 is provided above the combustion chamber 6, the spark plug 7 being connected to an ignition circuit 8 which includes an ignitor and other components.

An intake passage 10 supplies intake air to the combustion chamber 6 of each cylinder 2. The upstream end of the intake passage 10 is connected to an air cleaner 11, while the downstream end thereof is communicated to the combustion chamber 6 via an intake valve 12. The intake passage 10 is provided with an air flow sensor 13 for detecting the amount of air taken into the engine 1, a throttle valve 14 for throttling the intake passage 10, a surge tank 15, and four injectors 16 serving as a fuel supplying device, which injects fuel to the respectively cylinder independently, in the order in which they are listed from the upstream end. An intake air temperature sensor 17 provided on the air cleaner 11 detects the temperature of intake air. A throttle valve opening sensor 18 detects the opening of the throttle valve 14.

An exhaust passage 20 is the passage through which fuel gas is exhausted from the combustion chamber 6, the upstream end thereof being communicated to the combustion chamber 6. The exhaust passage 20 is provided with an $O_2$ sensor 22 for detecting an air-fuel ratio from the concentration of oxygen in an exhaust gas and a catalytic converter 23 composed of a catalytic converter rhodium for purifying the exhaust gas in this order from the upstream end.

The engine 1 is further provided with a crank angle sensor 26 formed primarily of an electromagnetic pickup for detecting the rotational angle of a crankshaft (not shown). The crank angle sensor 26 is disposed at a location corresponding to the outer periphery of a detection plate 27 provided on an end of the crankshaft. The crank angle sensor 26 issues pulse signals that correspond to crank angles as four protuberances provided on the outer periphery of the crankshaft pass when the detection plate 27 is turned as the crankshaft rotates; the crank angles may be, for example, −6 degrees, 104 degrees, 174 degrees, and 284 degrees, the upper dead center of each cylinder being zero degree. A water temperature sensor 28 for detecting the temperature of cooling water is provided adjacently to the water jacket to the cylinder block 3.

An electronic control unit (ECU) 30 shown in FIG. 1 is constituted primarily by a microcomputer. The ECU 30 receives output signals from the air flow sensor 13, the linear $O_2$ sensor 22, the throttle valve opening sensor 18, the crank angle sensor 26, and the water temperature sensor 28. The ECU 30 also issues control signals for ignition timings for the respective cylinders to the ignition circuit 8 and pulse signals for controlling the amount of fuel to be injected and injection timing to the injector 16 of each cylinder.

The ECU 30 carries out fuel control for synchronous injection effected in synchronization with the revolution of the engine for each cylinder in accordance with the signals received from the sensors. The ECU 30 also causes a fuel increaser 30*b* to execute asynchronous injection so as to increase the amount of fuel as soon as an acceleration start determiner 30*a* determines from a predetermined opening degree of the throttle valve 14 that the condition for starting the acceleration of the engine 1 has been satisfied.

The ECU 30 is further equipped with an idling determiner 30*c* that determines whether the engine 1 is in an idling mode, and an adjuster 30*d* that adjusts fuel amount for asynchronous injection according to the opening of the throttle valve 14 when the opening of the throttle valve 14 has been detected in the idling mode.

Figure 2:
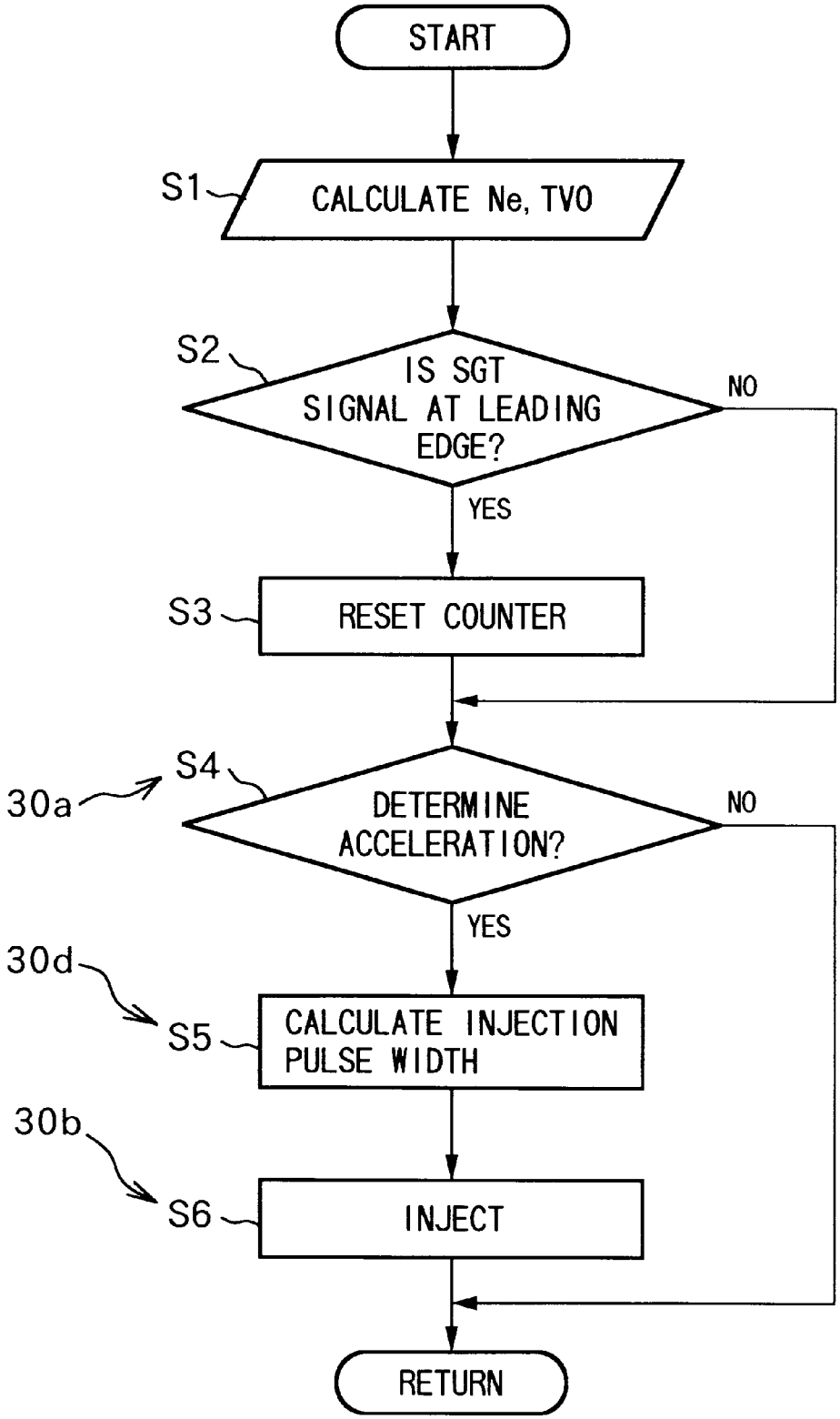
FIG. 2 is a flowchart illustrative of a procedure for controlling asynchronous injection.

Referring to the flowchart given in FIG. 2, the following will describe a specific procedure for controlling asynchronous injection when the engine 1 is in the idling mode. Whether the engine 1 is in the idling mode is determined by checking if an engine rpm Ne is a predetermined value, e.g. 600 rpm, or less. If it is determined that the engine 1 is not in the idling mode, then the following control will not be executed.

As shown in FIG. 2, first in a step S1, the output signals from various sensors are received, the current engine rpm Ne is calculated according to the pulse signal received from the crank angle sensor 26 among the various sensors, and a current throttle valve opening TVO is also calculated according to the input signal from the throttle valve opening sensor 18. Subsequently, in a step S2, it is determined whether a turn signal or SGT signal that can be switched ON/OFF in response to the pulse signals from the crank angle sensor 26 is at a leading edge, i.e. a timing at which the signal is switched from OFF to ON. If it is determined that the SGT signal is at the leading edge, i.e. the determination result is YES in the step S2, then a counter having its value incremented at intervals of a few milliseconds, for example, is reset; or if it is determined that the SGT signal is not at the leading edge, i.e. the determination result is NO in the step S2, then the ECU 30 proceeds to a step S4 without resetting the counter.

Figure 3:
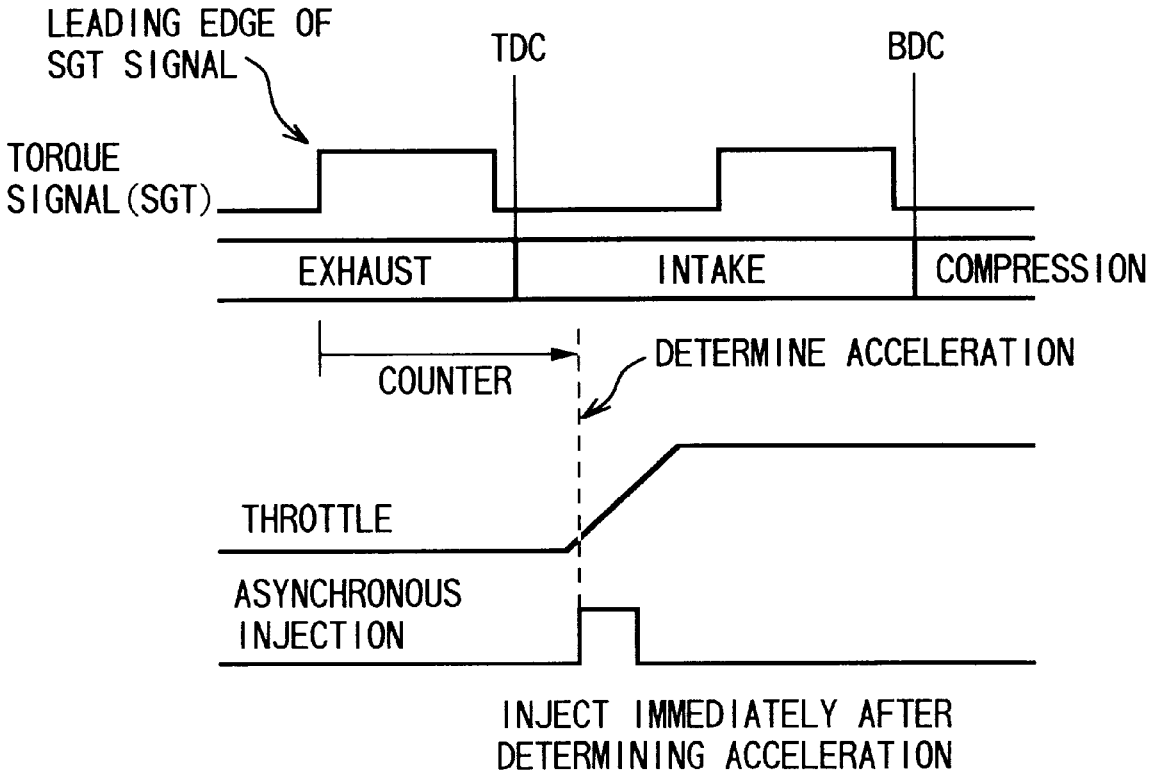
FIG. 3 is a schematic representation illustrative of the correlation among the crank angle position, opening timing of a throttle valve, and the injection timing of asynchronous injection in a first cylinder.

As illustrated in FIG. 3, when the intake top dead center (TDC) in each cylinder 2 of the engine 1 is taken as zero degree, the SGT signal is switched to ON at a crank angle of −76 degrees or 76 degrees BTDC, then switched to OFF at a crank angle of −6 degrees or 6 degrees BTDC, and it is switched back to ON at 104 degrees or 104 degrees ATDC, and switched back to OFF at 174 degrees or 174 degrees ATDC. Thus, since the SGT signal is switched ON and OFF alternately, the crank angle positions in the period between the later stage of an exhaust stroke and the middle stage of an intake stroke of each cylinder 2 can be accurately detected according to the values on the counter by resetting the counter every time the leading edge of the SGT signal is detected.

In a step S4 following the step S3, the ECU 30 determines whether the condition for starting the acceleration of the engine 1 has been satisfied according to the difference between the previous value and the present value of the throttle valve opening TVO. If the ECU 30 decides that the difference is too small and the acceleration should not be begun, i.e. the determination result in the step S4 is NO, then it goes to RETURN; if it decides that the difference in the throttle valve opening TVO is a predetermined value or more and the acceleration should be started, i.e. the determination result in the step S4 is YES, then it proceeds to a step S5. In the step S5, the ECU 30 calculates the injection pulse width of the injector 16 which corresponds to the amount of fuel to be injected for the asynchronous injection. More specifically, the ECU 30 refers to a map electronically stored beforehand in a ROM of the ECU 30 so as to calculate the injection pulse width according to the counter value mentioned above as illustrated in FIG. 4.

Figure 4:
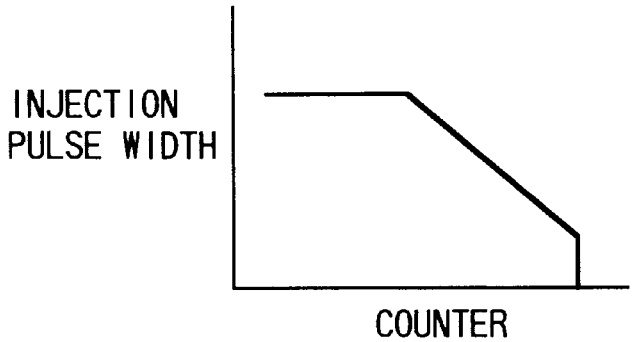
FIG. 4 is a diagram showing an example of a map wherein the pulse width of asynchronous injection has been set according to the crank angle position in the first cylinder.

In the map shown in FIG. 4, the injection pulse width of the asynchronous injection for a cylinder, namely, a first cylinder in which compression pressure is substantially increased first after it is determined that the condition for starting acceleration has been satisfied, is set according to a counter value that corresponds to the crank angle position of the first cylinder. To be more specific, when the acceleration start of the engine 1 is determined, if the first cylinder is somewhere between the middle and end stages of an exhaust stroke (e.g. between 76 degrees BTDC and 6 degrees BTDC), then the injection pulse is set to its maximum; or if the first cylinder is somewhere between the end stage of an exhaust stroke and the middle stage of an intake stroke (e.g. between 6 degrees BTDC and 104 degrees ATDC), then the injection pulse width is decreased as the timing at which the acceleration start is determined is delayed.

Figure 5:
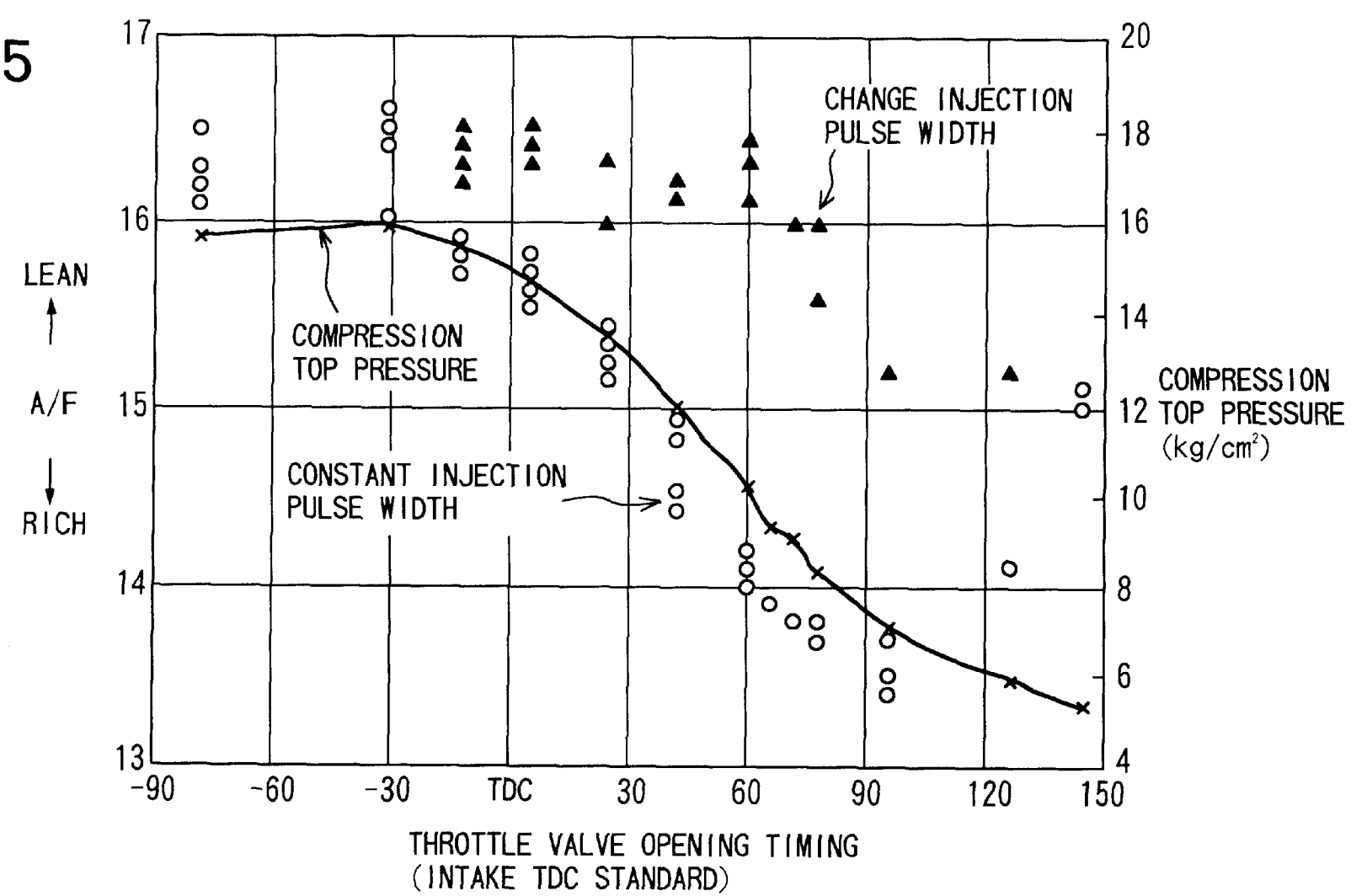
FIG. 5 is a graph illustrative of an example of the change in the air-fuel ratio of the first cylinder with respect to the change in the relative positions of the crank angle position and the opening timing of the throttle valve.

Thus, it is possible to prevent the air-fuel ratio of the fuel-air mixture from becoming excessively rich by decreasing the pulse width of asynchronous injection as the actual amount of intake air into a cylinder decreases as shown in FIG. 5. More specifically, if the pulse width of the asynchronous injection is set to a constant value, then the air-fuel ratio of the fuel-air mixture becomes richer as indicated by the circles in the chart as the compression pressure, namely, the compression top pressure, drops due to a decrease in the amount of intake air into a cylinder. The variations in the air-fuel ratio of the fuel-air mixture, however, can be suppressed by decreasing the pulse width of the asynchronous injection according to the crank angle position as indicated by the triangular marks in the chart. The pulse width of the asynchronous injection may be further adjusted so as to decrease as the engine rpm Ne decreases. This enables the variations in the air-fuel ratio of the fuel-air mixture to be further controlled.

In a step S6 following the step S5, the ECU 30 issues a pulse signal to the injector 16 to execute the asynchronous injection before it goes to RETURN. Thus, the asynchronous injection is performed as soon as it is determined that the condition for starting the acceleration of the engine 1 has been satisfied thereby to prolong the atomization and carburetion time for the fuel injected and supplied through an intake port, securely supplying a sufficient amount of fuel to be supplied into a cylinder. Since the asynchronous injection is carried out as soon as the acceleration start is determined, it is possible that the asynchronous injection and the basic synchronous injection interfere with each other; in such a case, only the synchronous injection may be performed by adding the pulse width of the asynchronous injection to the pulse width of the basic synchronous injection.

In the flowchart of FIG. 2, the step S4 is associated with the acceleration start determiner 30*a*, the step S5 is associated with the adjuster 30*d*, and the step S6 is associated with the fuel increaser 30*b*.

Therefore, in the first embodiment, when the engine 1 is in the idling mode and if it is determined that the condition for starting the acceleration of the engine 1 has been satisfied according to the opening of the throttle valve 14, then the injection pulse width of asynchronous injection carried out by the fuel increaser 30*b* is changed by the adjuster 30*d* in accordance with the timing at which the throttle valve 14 is opened. This makes it possible to control the variations in the air-fuel ratio of a fuel-air mixture in a first cylinder, in which the compression pressure substantially increases first after the determination of acceleration, to a predetermined level.

Figure 10:
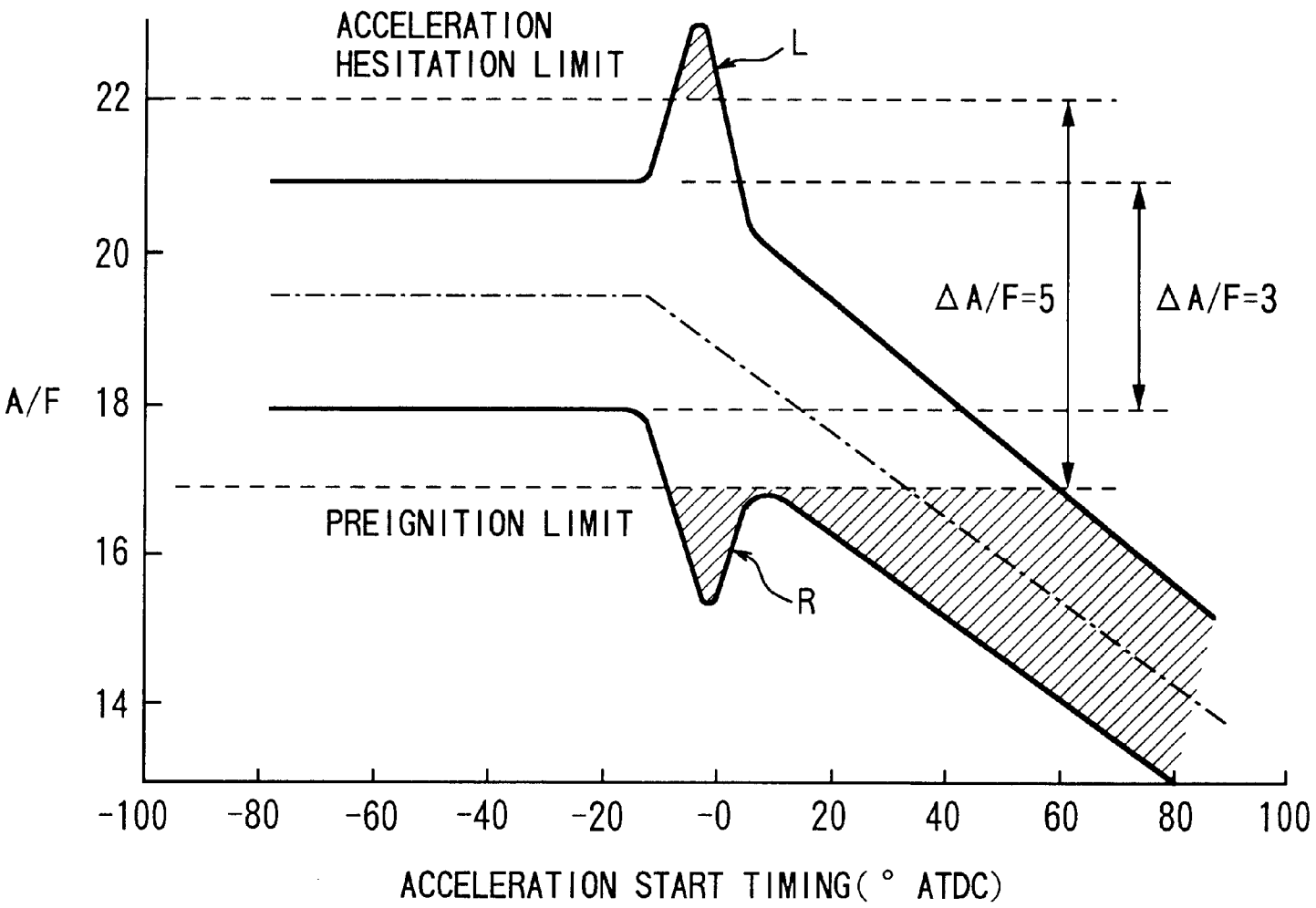
FIG. 10 is a schematic representation illustrative of the air-fuel ratio in the first cylinder which becomes richer as the timing of opening the throttle valve in relation to the crank angle position is delayed.

To be more specific, the air-fuel ratio of a fuel-air mixture can be set to a value in a range defined as $16<A/F<21$, that is, to a value between an acceleration hesitation limit at which the engine 1 incurs hesitation at the time of acceleration (see FIG. 10) and a preignition limit at which preignition occurs. This makes it possible to prevent both preignition and the consequent abnormal noise, and deterioration in drivability at the start of acceleration.

Since the engine 1 has a high compression ratio and a low idling speed and it is mounted on a vehicle equipped with an automatic transmission, the engine 1 is frequently shifted from the idling mode to the acceleration mode at the time of starting the vehicle. The operation and advantage of the first embodiment set forth above are especially displayed by applying the invention to the engine 1 that tends to incur such preignition.

Second Embodiment

Figure 6:
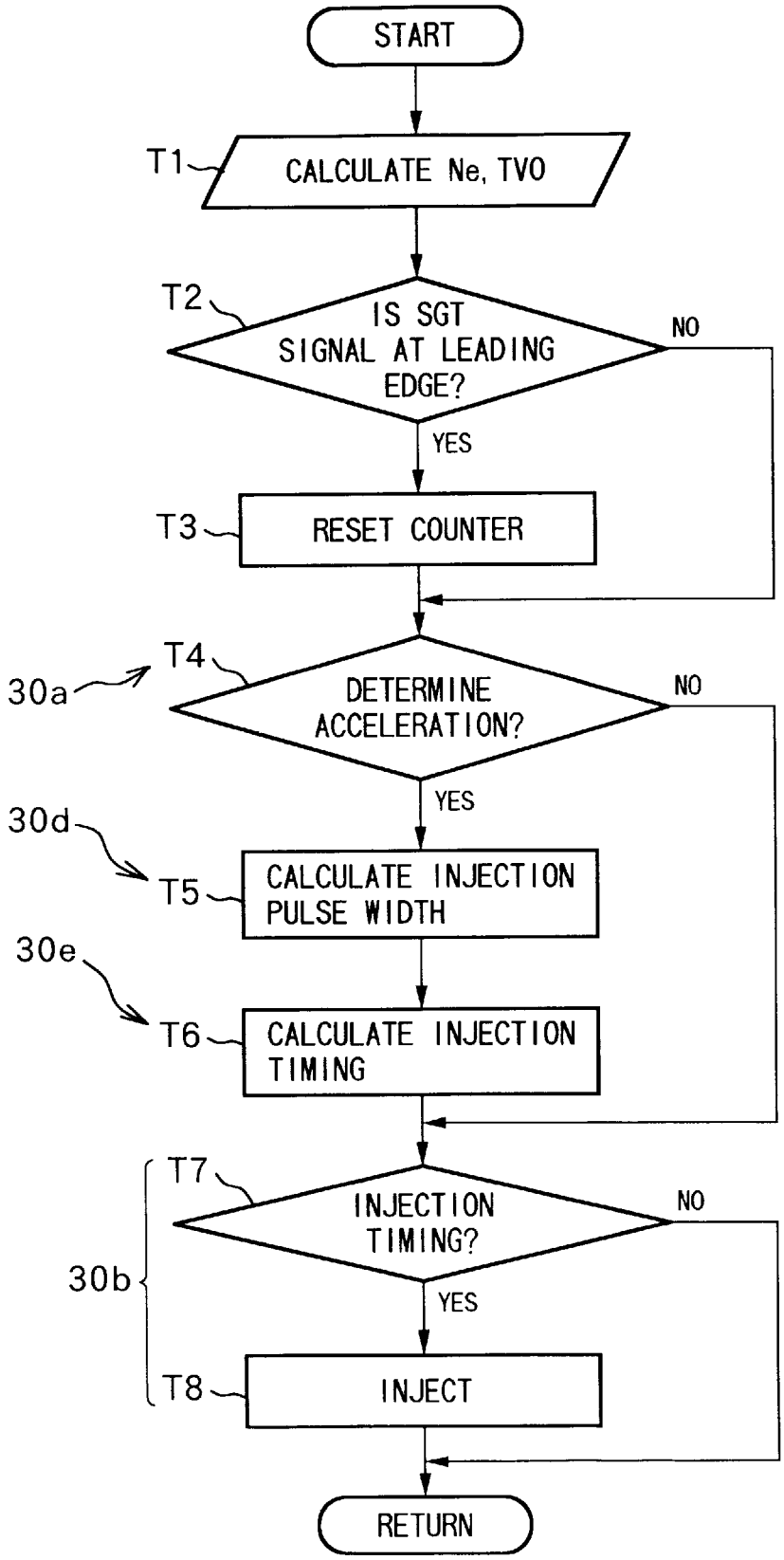
FIG. 6 is a flowchart illustrative of a procedure for controlling asynchronous injection according to a second embodiment.

FIG. 6 shows a flowchart illustrative of an asynchronous injection control procedure of a second embodiment in accordance with the invention. A fuel control unit of the second embodiment is configured in the same manner as that of the first embodiment shown in FIG. 1. Only the procedure for controlling the increase of fuel by an ECU 30 at the time of the determination of acceleration in the second embodiment is partly different from that of the first embodiment; therefore, only the different portion will be discussed in detail, like reference numerals being assigned to like components.

As shown in FIG. 6, the processing from steps T1 through T5 is identical to the processing of S1 through S5 shown in FIG. 2. In the step T5, the-ECU 30 refers to the same map (see FIG. 4) as that used in the step S5 to calculate the injection pulse width of asynchronous injection, then it calculates an injection timing in the following step T6.

Figure 7:
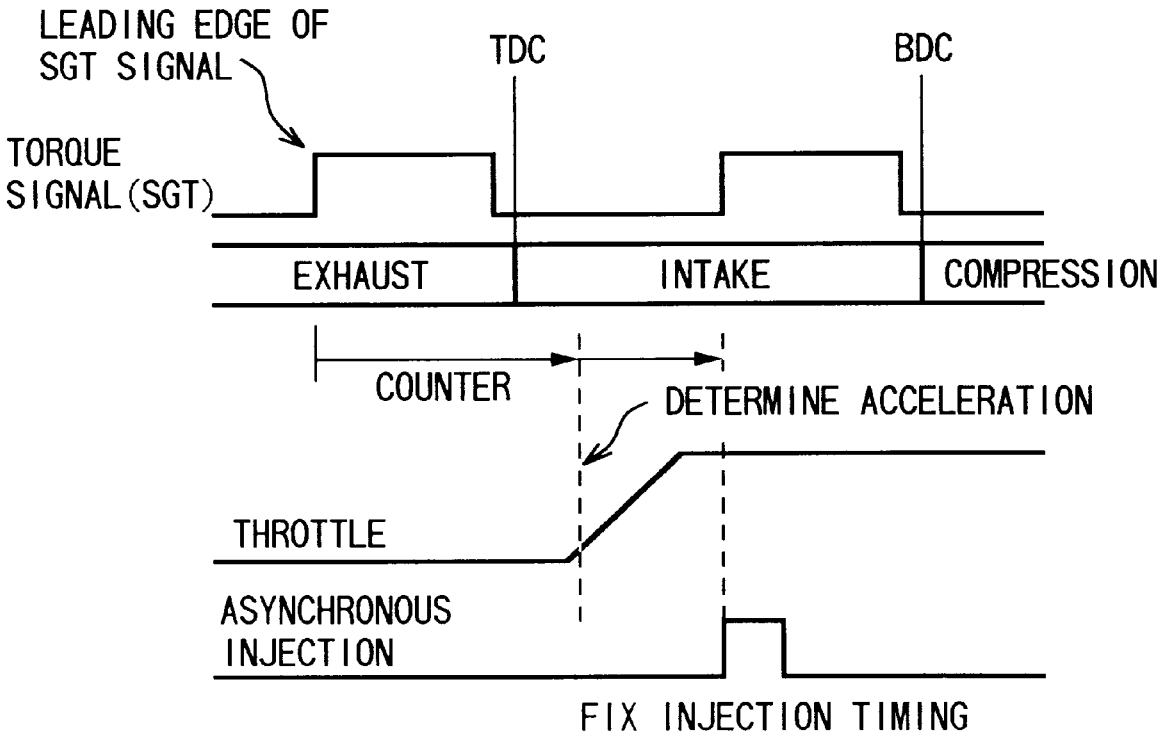
FIG. 7 is a diagram showing an example of a map wherein the pulse width of asynchronous injection has been set according to the crank angle position in the first cylinder in accordance with the second embodiment.
Figure 8:
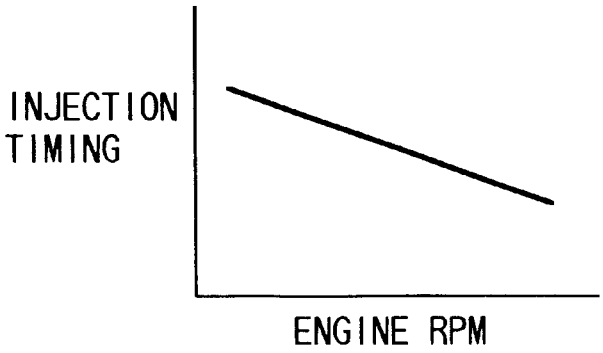
FIG. 8 is a schematic representation illustrative of the correlation among the crank angle position, opening timing of a throttle valve, and the injection timing of asynchronous injection in a first cylinder in accordance with the second embodiment.
Figure 9:
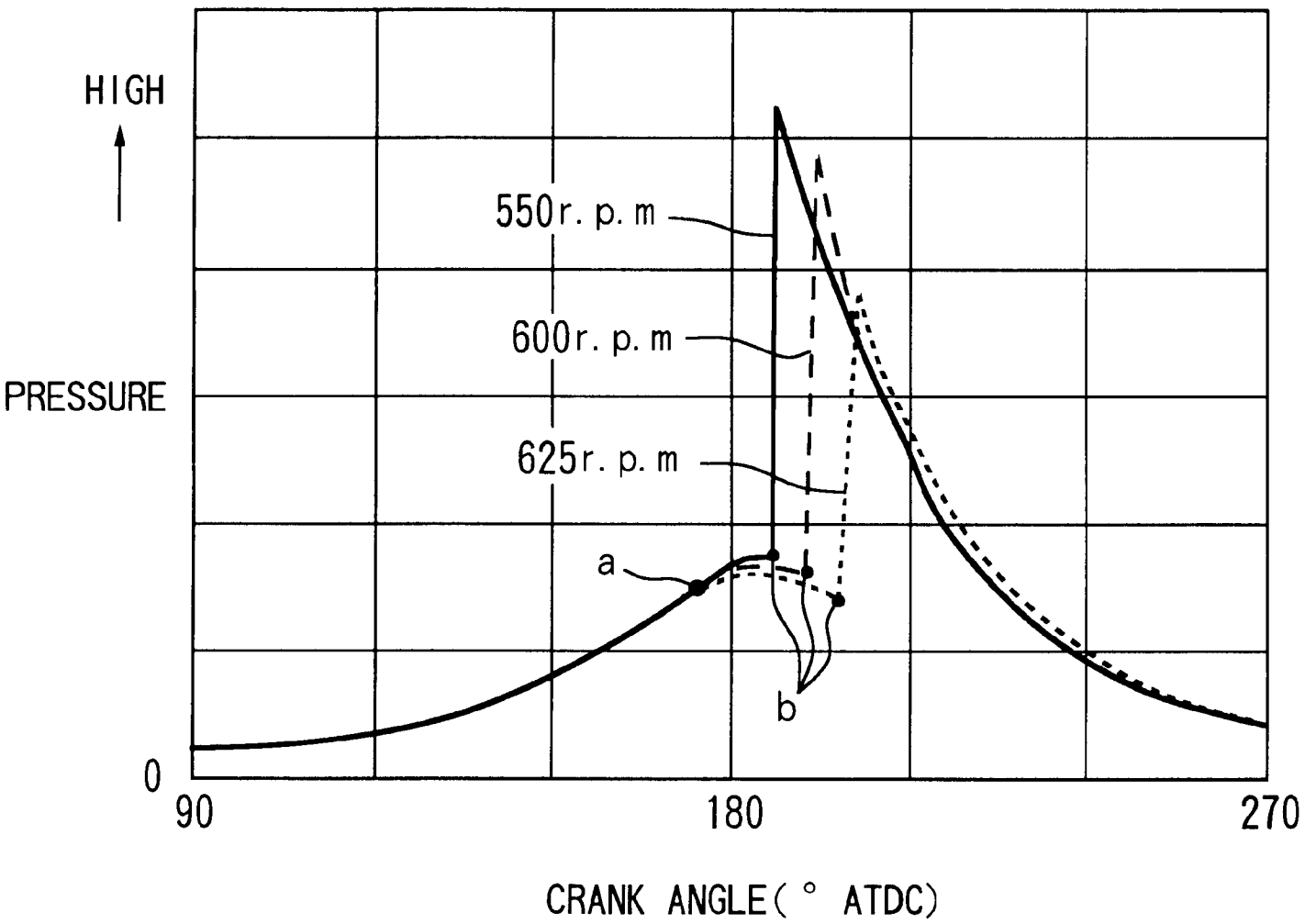
FIG. 9 is a graph illustrative of an abnormal rise in the pressure in a cylinder caused by preignition, which is associated with the crank angle position.

More specifically, the ECU 30 refers to a map, which has been prepared in advance according to an engine rpm Ne as shown in FIG. 7, during the intake stroke of each cylinder to calculate the injection timing of asynchronous injection. In this map, the injection timing of asynchronous injection is set based on a predetermined point (supply point) in the middle stage of an intake stroke of each cylinder as shown in FIG. 8 and it is set so as to advance the injection timing as the engine rpm Ne increases.

In a step T7 following the step T6, the ECU 30 determines whether the injection timing calculated in the step T6 has been reached. If the ECU 30 determines that the calculated injection timing has not been reached, i.e. if the determination result in the step T7 is NO, then it goes to RETURN; if it decides that the injection timing has been reached, i.e. if the determination result in the step T7 is YES, then it proceeds to a step T8 to carry out the asynchronous injection before going to RETURN.

In the flowchart given in FIG. 6, the step T4 is associated with an acceleration start determiner 30*a*, the step T5 is associated with an adjuster 30*d*, the step T6 is associated with a supply timing adjuster 30*e*, and the steps T7 and T8 are associated with a fuel increaser 30*b*.

Thus, according to the second embodiment, as in the case of the first embodiment, both the preignition followed by a consequent abnormal noise and the deterioration in drivability at the acceleration start of the engine 1 can be prevented. Further, in the second embodiment, the asynchronous injection is implemented during an intake stroke of each cylinder; therefore, injected fuel can be efficiently charged in the cylinder.

Moreover, synchronous injection is usually carried out at the end stage of an exhaust stroke, so that adverse influences due to interference between the asynchronous injection and the synchronous injection can be obviated. For example, if the difference in timing between synchronous injection and asynchronous injection causes the opening duration of an injector 16 to be shortened, then an insufficient amount of fuel is injected and the air-fuel ratio of the fuel-air mixture may become extremely lean as indicated by a region L shown in FIG. 10. On the other hand, if the interval between the synchronous injection and the asynchronous injection becomes extremely small, then the injector 16 may be left open and the air-fuel ratio of the fuel-air mixture may become extremely rich as indicated by a region R shown in FIG. 10. The second embodiment allows the adverse influences described above to be obviated by preventing the interference between the synchronous injection and the asynchronous injection.

Furthermore, since the injection timing is adjusted to be advanced as the engine rpm Ne increases, adequate atomization and carburetion time for injected fuel is secured to supply sufficient fuel to a cylinder even when the engine rpm Ne increases and the opening duration of an intake valve becomes relatively shorter.

Other Embodiments

It is to be understood that the invention is not limited to the specific embodiments set forth above and that it includes many other embodiments. For example, in the embodiments described above, the adjustment for changing the pulse width of asynchronous injection in accordance with the opening timing of a throttle valve 14 may not be made if an engine 1 has not yet been warmed up. This makes it possible to prevent the deterioration of drivability such as hesitation by adding a sufficient amount of fuel at the start of acceleration even when the engine has not been warmed up and atomization and carburetion of fuel is in a poor state.

In the foregoing embodiments, the pulse width of asynchronous injection may be changed for adjustment only if the temperature of intake air into the engine 1 is, for example, 80 degrees Celsius or higher. This enables acceleration drivability to be improved by adding a sufficient amount of fuel since preignition hardly takes place when the intake air temperature is lower than 80 degrees Celsius.

Further, the foregoing embodiments are adapted to make an adjustment to change the injection pulse width of asynchronous injection in order to control the variations in the air-fuel ratio of a fuel-air mixture in a first cylinder, in which compression pressure substantially increases first after it is determined that the condition for starting acceleration has been satisfied, to a predetermined range. The injection pulse width of asynchronous injection may be changed also for a second cylinder that is to be ignited following the first cylinder.

More specifically, the preignition in the second cylinder can be usually suppressed as the rpm of the engine 1 increases when the combustion in the first cylinder takes place. Controlling the air-fuel ratio of the fuel-air mixture to the predetermined range by changing the injection pulse width of asynchronous injection also in the second cylinder as described above makes it possible to prevent preignition in the second cylinder even if the engine rpm fails to increase due to a misfire or other problem in the first cylinder.

Thus, the fuel control unit for a multi-cylinder engine in accordance with the embodiments is designed to carry out adjustment processing to reduce the degree of the increase of fuel effected by the fuel increaser so as to control the air-fuel ratio of a fuel-air mixture to a desired range in a first cylinder wherein preignition is likely to occur first after the acceleration start is determined when an engine shifts from an idling mode to an acceleration mode. This prevents the air-fuel ratio of a fuel-air mixture in the first cylinder from becoming excessively rich, permitting the prevention of preignition and a resultant abnormal noise.

Even if the engine rpm fails to increase due to a misfire or other problem in a first cylinder, preignition in a second cylinder can be prevented.

When the engine has not been warmed up, a sufficient amount of fuel is added at the start of acceleration, so that the deterioration in drivability represented by hesitation can be prevented.

When the temperature of intake air is lower than 80 degrees Celsius, a sufficient amount of fuel is added at the start of acceleration to improve acceleration drivability.

A predetermined range for controlling the variations in the air-fuel ratio of a fuel-air mixture is specified, and controlling the air-fuel ratio to a value within the predetermined range reliably prevents preignition and a consequent abnormal noise and the deterioration in acceleration drivability.

The air-fuel ratio of the fuel-air mixture in the first cylinder can be set to a value within the predetermined range by adjusting the degree of the increase of fuel effected by the fuel increaser in accordance with the opening timing of a throttle valve.

A sufficient amount of fuel can be securely supplied to a cylinder by supplying fuel for increasing the amount of fuel as soon as it is determined that the condition for starting the acceleration of an engine has been satisfied.

The fuel supplied for adding to the amount of fuel can be efficiently supplied into a cylinder. The adverse influences caused by the interference between this fuel supply and basic fuel supply carried out in synchronization with engine revolution can be obviated.

Even when the engine speed increases, the atomization and carburetion time for the fuel supplied to add to the amount of fuel can be secured to allow a sufficient amount of fuel to be supplied into a cylinder.

The operation and advantage of the invention can be especially effectively displayed by applying the invention to an engine that has a high compression ratio and a low idling speed, and to an engine which has a high compression ratio and a low idling speed and which is mounted on a vehicle equipped with an automatic transmission.

The present invention is not limited to the above embodiments and various changes and modifications can be made within the spirit and scope of the present invention. Therefore, to apprise the public of the scope of the present invention, the following claims are made.

What is claimed is:

1. A fuel control unit for a multi-cylinder engine including:

acceleration start determining means for determining that a condition for starting the acceleration of the multi-cylinder engine has been satisfied;

fuel supplying means for supplying fuel independently to respective cylinders of the engine; and fuel increasing means for causing the fuel supplying means to supply fuel to increase the amount of fuel at the time of acceleration when the acceleration start determining means determines that the condition for starting the acceleration has been satisfied;

the fuel control unit for a multi-cylinder engine comprising:

idling determining means for determining an idling mode of the engine; and adjusting means for making an adjustment to reduce the degree of an increase of fuel effected by the fuel increasing means if it is determined by the acceleration start determining means that the condition for starting the acceleration of the engine has been satisfied with the idling mode of the engine having been determined by the idling determination means, so as to adjust an air-fuel ratio of a fuel-air mixture in a cylinder, in which compression pressure increases first due to an increase in the amount of charged intake air when a throttle valve is opened after the determination, to a value within a predetermined range.

2. A fuel control unit for a multi-cylinder engine according to claim 1, wherein the adjusting means makes an adjustment so as to reduce the degree of the increase of fuel effected by the fuel increasing means so that the air-fuel ratio in a second cylinder, in which compression pressure is increased following the first cylinder, also takes a value within a predetermined range.

3. A fuel control unit for a multi-cylinder engine according to claim 1, wherein the adjusting means suspends the adjustment of the degree of the increase of fuel if the engine has not been warmed up.

4. A fuel control unit for a multi-cylinder engine according to claim 1, wherein the adjusting means adjusts the degree of the increase of fuel only if an intake air temperature is 80 degrees Celsius or higher.

5. A fuel control unit for a multi-cylinder engine according to claim 1, wherein the air-fuel ratio in the predetermined range is defined as A (air)/F (fuel)>14.7, the difference between maximum and minimum values being 5 or less in terms of A/F.

6. A fuel control unit for a multi-cylinder engine according to claim 1, wherein the adjusting means makes an adjustment to reduce the degree of the increase of fuel effected by the fuel increasing means as the timing for determining the acceleration start is delayed if the first cylinder is in a period between an ending stage of an exhaust stroke and an intake stroke when the acceleration determining means determines the acceleration start of the engine.

7. A fuel control unit for a multi-cylinder engine according to claim 6, wherein the fuel increasing means causes the fuel supplying means to supply fuel as soon as the acceleration start determining means determines that the condition for starting the acceleration of the engine has been satisfied.

8. A fuel control unit for a multi-cylinder engine according to claim 6, wherein the fuel increasing means causes the fuel supplying means to supply fuel at a predetermined supply timing in an intake stroke when the acceleration start determining means determines that the condition for starting the acceleration of the engine has been satisfied.

9. A fuel control unit for a multi-cylinder engine according to claim 8, wherein the fuel increasing means makes an adjustment so as to advance the predetermined supply timing as an engine rpm increases.

10. A fuel control unit for a multi-cylinder engine according to claim 1, wherein the engine is set to have a compression ratio of 9 or more and an idling rpm of 600 or less.

11. A fuel control unit for a multi-cylinder engine according to claim 1, wherein the engine is mounted on a vehicle equipped with an automatic transmission.

12. A fuel control method for a multi-cylinder engine including:

acceleration start determining means for determining that a condition for starting the acceleration of the multi-cylinder engine has been satisfied;

fuel supplying means for supplying fuel independently to respective cylinders of the engine; and fuel increasing means for causing the fuel supplying means to supply fuel to increase the amount of fuel at the time of acceleration when the acceleration start determining means determines that the condition for starting the acceleration of the engine has been satisfied;

the fuel control method for a multi-cylinder engine comprising:

an idling determining step for determining an idling mode of the engine; and an adjusting step for making an adjustment to reduce the degree of an increase of fuel effected by the fuel increasing means if it is determined by the acceleration start determining means that the condition for starting the acceleration of the engine has been satisfied with the idling mode of the engine having been determined by the idling determination means, so as to adjust an air-fuel ratio of a fuel-air mixture in a cylinder, in which compression pressure increases first due to an increase in the amount of charged intake air when a throttle valve is opened after the determination, to a value within a predetermined range.

13. A fuel control method for a multi-cylinder engine according to claim 12, wherein the adjusting step makes an adjustment so as to reduce the degree of the increase of fuel effected by the fuel increasing means so that the air-fuel ratio in a second cylinder, in which compression pressure is increased following the first cylinder, also takes a value within a predetermined range.

14. A fuel control method for a multi-cylinder engine according to claim 12, wherein the adjusting step suspends the adjustment of the degree of the increase of fuel if the engine has not been warmed up.

15. A fuel control method for a multi-cylinder engine according to claim 12, wherein the adjusting step adjusts the degree of the increase of fuel only if an intake air temperature is 80 degrees Celsius or higher.

16. A fuel control method for a multi-cylinder engine according to claim 12, wherein the air-fuel ratio in the predetermined range is defined as A (air)/F (fuel)>14.7, the difference between maximum and minimum values being 5 or less in terms of A/F.

17. A fuel control method for a multi-cylinder engine according to claim 12, wherein the adjusting step makes an adjustment to reduce the degree of the increase of fuel effected by the fuel increasing means as the timing for determining the acceleration start is delayed if the first cylinder is in a period between an ending stage of an exhaust stroke and an intake stroke at the time when the acceleration determining means determines the acceleration start of th e engine.

18. A fuel control method for a multi-cylinder engine according to claim 17, wherein the fuel increasing means causes the fuel supplying means to supply fuel as soon as the acceleration start determining means determines that the condition for starting the acceleration of the engine has been satisfied.

19. A fuel control method for a multi-cylinder engine according to claim 17, wherein the fuel increasing means causes the fuel supplying means to supply fuel at a predetermined supply timing in an in take stroke when the acceleration start determining means determines that the condition for starting the acceleration of the engine has been satisfied.

20. A fuel control method for a multi-cylinder engine according to claim 19, wherein the fuel increasing means makes an adjustment so as to advance the predetermined supply timing as an engine rpm increases.

21. A fuel control method for a multi-cylinder engine according to claim 12, wherein the engine is set to have a compression ratio of 9 or more and an idling rpm of 600 or less.

22. A fuel control method for a multi-cylinder engine according to claim 12, wherein the engine is mounted on a vehicle equipped with an automatic transmission.

23. A fuel control unit for a multi-cylinder engine including:

an injector for supplying fuel independently to respective cylinders of the multi-cylinder engine; and a control processing unit which determines that a condition for starting acceleration of the engine has been satisfied, and causes the injector to supply fuel to increase the amount of fuel for the acceleration when it determines that the condition for starting the acceleration of the engine has been satisfied;

the fuel control unit for a multi-cylinder engine comprising:

idling determining processor for determining an idling mode of the engine; and an adjustment processing unit for making an adjustment to reduce the degree of an increase of fuel effected by the injector if it is determined by the control processing unit that the condition for starting the acceleration of the engine has been satisfied with the idling mode of the engine having been determined by the idling determining means, so as to adjust an air-fuel ratio of a fuel-air mixture in a cylinder, in which compression pressure increases first due to an increase in the amount of charged intake air when a throttle valve is opened after the determination, to a value within a predetermined range;

wherein the adjustment processing unit makes an adjustment to reduce the degree of the increase of fuel effected by the injector as a timing at which an acceleration start of the engine is determined is delayed if a first cylinder is in a period between an ending stage of an exhaust stroke and an intake stroke when the acceleration start is determined by the control processing unit.

* * * * *